US008097306B2

(12) United States Patent
Yamaguchi et al.

(10) Patent No.: US 8,097,306 B2
(45) Date of Patent: Jan. 17, 2012

(54) AQUEOUS TREATING SOLUTION FOR SN-BASED PLATED STEEL SHEET EXCELLENT IN CORROSION RESISTANCE AND PAINT ADHESION, AND PRODUCTION METHOD OF SURFACE-TREATED STEEL SHEET

(75) Inventors: Shinichi Yamaguchi, Tokyo (JP); Masao Kurosaki, Tokyo (JP); Yasuto Goto, Tokyo (JP); Manabu Kumagai, Tokyo (JP); Kensuke Mizuno, Tokyo (JP); Takumi Kozaki, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 508 days.

(21) Appl. No.: 12/310,605

(22) PCT Filed: Sep. 6, 2007

(86) PCT No.: PCT/JP2007/067772

§ 371 (c)(1),
(2), (4) Date: Feb. 26, 2009

(87) PCT Pub. No.: WO2008/029953

PCT Pub. Date: Mar. 13, 2008

(65) Prior Publication Data

US 2010/0239773 A1 Sep. 23, 2010

(30) Foreign Application Priority Data

Sep. 7, 2006 (JP) ..... 2006-242221

(51) Int. Cl.
*B05D 7/14* (2006.01)

(52) U.S. Cl. ..... 427/384; 427/397.7

(58) Field of Classification Search ..... None
See application file for complete search history.

(56) References Cited

U.S. PATENT DOCUMENTS

| | | | | |
|---|---|---|---|---|
| 6,235,348 | B1 * | 5/2001 | Shimizu et al. | 427/388.1 |
| 2002/0146514 | A1 | 10/2002 | Chung et al. | |
| 2004/0173289 | A1 | 9/2004 | Kinoshita et al. | |

FOREIGN PATENT DOCUMENTS

| | | |
|---|---|---|
| EP | 0 916 746 | 5/1999 |
| JP | 58-045396 | 3/1983 |
| JP | 05-106058 | 4/1993 |
| JP | 7-11454 | 1/1995 |
| JP | 09-053185 | 2/1997 |
| JP | 10-081976 | 3/1998 |
| JP | 10-081977 | 3/1998 |
| JP | 10-168581 | 6/1998 |
| JP | 10-176279 | 6/1998 |
| JP | 10-212586 | 8/1998 |
| JP | 11-217682 | 8/1999 |
| JP | 11-256354 | 9/1999 |
| JP | 11-286790 | 10/1999 |
| JP | 2000-008176 | 1/2000 |
| JP | 2001-032085 | 2/2001 |
| JP | 2001-098387 | 4/2001 |
| JP | 2001-181855 | 7/2001 |
| JP | 2001-335958 | 12/2001 |
| JP | 2002-146550 | 5/2002 |
| JP | 2002-226981 | 8/2002 |
| JP | 2002-256447 | 9/2002 |
| JP | 2004-531639 | 10/2004 |
| JP | 2004-346360 | 12/2004 |
| JP | 2005-240068 | 9/2005 |
| JP | 2006-028547 | 2/2006 |
| WO | WO/02/20874 | 3/2002 |

OTHER PUBLICATIONS

Canadian Office Action dated Jun. 13, 2011 issued in corresponding Canadian Application No. 2,662,611.
International Search Report dated Nov. 13, 2007 issued in corresponding PCT Application No. PCT/JP2007/067772.

* cited by examiner

*Primary Examiner* — Erma Cameron
(74) *Attorney, Agent, or Firm* — Kenyon & Kenyon LLP

(57) ABSTRACT

An aqueous treating solution for an Sn-based plated steel sheet, comprising (A) an organic material, (B) a water-soluble chromium compound, (C) a water-dispersible silica, and water, wherein the organic material (A) is at least one member selected from an oxy-acid with the ratio of hydroxyl group/carboxyl group in one molecule being from 3/1 to 10/1, its lactone form and an oxide derivative thereof, the water-soluble chromium compound (B) does not contain hexavalent chromium, and pH is from 0.7 to 6.0.

9 Claims, No Drawings

AQUEOUS TREATING SOLUTION FOR SN-BASED PLATED STEEL SHEET EXCELLENT IN CORROSION RESISTANCE AND PAINT ADHESION, AND PRODUCTION METHOD OF SURFACE-TREATED STEEL SHEET

CROSS-REFERENCE TO RELATED APPLICATIONS

This application claims priority based on Japanese Patent Application No. 2006-242221, filed on Sep. 7, 2006, the entire contents of which are incorporated herein by reference.

TECHNICAL FIELD

The present invention relates to an aqueous treating solution for a hexavalent chromium-free and surface-treated Sn-based plated steel sheet excellent in corrosion resistance and paint adhesion and useful as a material for automobile fuel tanks, household electric appliances and industrial machines, and a production method of a plated steel sheet.

BACKGROUND ART

Conventionally, a Pb—Sn-based plated steel sheet excellent in corrosion resistance, processability, solderability (weldability) and the like has long been used as a material for automobile fuel tanks, but recent stringent environmental restrictions on the use of Pb has made it difficult for use in this system. A variety of steel sheets have been proposed as an alternative. Above all, an Sn—Zn plated steel sheet is excellent in corrosion resistance, processability and profitability, and its use is becoming widespread.

A surface-treated steel sheet for fuel tanks, obtained by applying a treatment of hexavalent chromium-containing chromate onto Zn—Ni alloy plating, is disclosed in Japanese Unexamined Patent Publication (Kokai) Nos. 58-45396 and 5-106058. Also, a material obtained through hot-dip Zn-galvanization and chromate treatment is disclosed in Japanese Unexamined Patent Publication (Kokai) Nos. 10-168581 and 11-217682.

The treatment with a hexavalent chromium-containing solution is excellent in view of corrosion resistance and profitability, but hexavalent chromium is an environmental load substance of which restriction on use is becoming more limited. In order to solve this problem, there have been proposed, for example, a method of reducing hexavalent chromium in Japanese Unexamined Patent Publication (Kokai) No. 2006-028547 and a method using an Si-based chemical without chromium in Japanese Unexamined Patent Publication (Kokai) No. 2001-32085. However, depending on the corrosion resistance evaluation under severe conditions or depending on the welding conditions, the objective performance cannot be satisfactorily achieved by chromium-free conventional techniques. Also, a method using a trivalent chromium with less environmental load has been proposed, for example, in WO02/20874, but as described later, the conventional technique is a treatment based on a Zn-galvanized steel sheet and even when this treatment is directly applied to an Sn-based plated steel sheet with a different surface state, paint adhesion is insufficient.

On the other hand, in the case of a material for automobile fuel tanks, a steel sheet subjected to Pb—Sn-based plating known as terne plating has been used, but regulations in Europe inhibit use of Pb, and a hot-dip Al-plated steel sheet or a hot-dip Sn—Zn plated steel sheet comes into use.

In conventional techniques, a method of obtaining a treatment solution with good liquid stability by combining a trivalent chromium and an organic acid is disclosed in Japanese Unexamined Patent Publication (Kokai) Nos. 10-81977, 10-81976, 10-176279, 10-212586, 11-256354, 2001-181855 and 2002-146550, but the main aim thereof is to reduce the amount of hexavalent chromium in the treatment solution and due to lack of sufficient studies on the ratio of hydroxyl group/carboxyl group in the organic acid molecule, which is described later, satisfactory performance is not necessarily obtained in view of paint adhesion/water resistance. Similarly, in Japanese Unexamined Patent Publication (Kokai) No. 2001-335958, an organic acid having an optimal hydroxyl group/carboxyl group ratio, which is described later, is not applied and since enhancement of paint adhesion has not been studied, paint adhesion is poor. It is disclosed that a silicate can be coated by a two-step treatment, but a water-soluble silicate is generally a salt with an alkali metal and unlike water-dispersible silica, there is no effect of enhancing paint adhesion.

Furthermore, the inventions described in Japanese Unexamined Patent Publication (Kokai) Nos. 2002-256447 and 2004-346360 have premise on water washing after coating and drying, and therefore, in addition to the reasons above, the amount of the component dissolved increases in the film components resulting in poor paint adhesion. In WO02/20874 and Japanese Unexamined Patent Publication (Kokai) No. 2002-226981, paint adhesion has not been studied. An organic material having a specific hydroxyl group is not contained and as regards the water-dispersible silica, the combination of spherical silica and chain silica is not studied, as a result, the alkali resistance and paint adhesion are inferior.

DISCLOSURE OF THE INVENTION

The present invention has been made to solve the problems in those conventional techniques and an object of the present invention is to provide a hexavalent Cr-free aqueous treating solution excellent in paint adhesion as well as in corrosion resistance, and an Sn-based plated steel sheet subjected to a rust-preventing treatment using the same.

As a result of intensive studies, the present inventors have found that the above-described object can be attained by using a treating solution containing a hydroxycarboxylic acid having a specific structure, a trivalent chromium and a water-dispersible silica. In other words, the cause why the Sn-based plated steel sheet is disadvantageous in the paint adhesion is investigated, and it was found that a main cause is a low wettability of tin oxide ($SnO$, $SnO_2$) produced on the plating surface during production or natural standing. Intensive studies have been made based on this finding, and as a result, it has been clarified that an hydroxycarboxylic acid having a specific structure, in which a part of the carboxylic acid in the molecule forms a complex with Sn to enhance the plating-to-film adhesion and since the other hydroxyl group ensures adhesion to a paint, and therefore, excellent paint adhesion can be ensured. The Sn-based plating as used herein means plating where the Sn content (wt %) in the plating layer is 20% or more. When the Sn content is 20% or more, tin oxide exerts its adverse effect on paint adhesion. When the Sn content (wt %) is 50% or more, paint adhesion is further worsened and therefore, paint adhesion resulting from formation of a complex of carboxylic acid becomes prominent. When the Sn content is 80% or more, paint adhesion can not be ensured and therefore, the effect of the present invention becomes more prominent.

The present invention resides in an aqueous treating solution for an Sn-based plated steel sheet, comprising (A) an organic material, (B) a water-soluble chromium compound, (C) a water-dispersible silica, and water, wherein the organic material (A) is at least one member selected from an oxy-acid with the ratio of hydroxyl group/carboxyl group in one molecule being from 3/1 to 10/1, its lactone form and an oxide derivative thereof, the water-soluble chromium compound (B) does not contain hexavalent chromium, and the pH is from 0.7 to 6.0.

The organic material (A) contained in the aqueous treating solution of the present invention is preferably an organic material having a carbon number of 4 to 12.

The organic material (A) is preferably an aliphatic compound rather than an aromatic compound. The organic material (A) is more preferably ascorbic acid or a derivative thereof.

The water-dispersible silica (C) for use in the aqueous treating solution of the present invention preferably comprises at least two kinds of silicas, i.e., spherical silica and chain silica, and the weight ratio therebetween is preferably chain silica/spherical silica=from 2/8 to 8/2 in terms of $SiO_2$. The aqueous treating solution of the present invention preferably contains (D) phosphoric acid and/or a phosphoric acid compound as an additional component, and the total weight ratio between Cr in the treating solution of the present invention and $PO_4$ in the phosphoric acid and/or phosphoric acid component (D) is preferably $PO_4$/Cr=from 1/1 to 3/1. Furthermore, it is preferred that the aqueous treating solution of the present invention contains (E) a metal salt as an additional component, the metal is at least one member selected from the group consisting of Mg, Ca, Ba, Sr, Co, Ni, Zr, W and Mo, and the weight ratio of metal to Cr is metal/Cr=from 0.01/1 to 0.5/1.

The present invention exerts a highest effect by coating the aqueous treating solution of the present invention on a steel sheet having formed thereon an Sn—Zn plating layer comprising from 1 to 8.8 mass % of Zn and from 91.2 to 99.0 mass % of Sn, and drying the steel sheet. Also, this is a method for producing an Sn-based plated steel sheet with high corrosion resistance and excellent paint adhesion, wherein the coating weight after coating and drying the aqueous treating solution of the present invention on the Sn-based plated steel sheet is, in terms of metal chromium, from 3 to 100 mg/$m^2$ per one surface.

In other words, the present invention includes an aqueous treating solution for an Sn-based surface-treated steel sheet, comprising (A) an organic material, (B) a water-soluble chromium compound, (C) a water-dispersible silica, and water, wherein the organic material (A) is at least one member selected from an oxy-acid with the ratio of hydroxyl group/carboxyl group in one molecule being from 3/1 to 10/1, its lactone form and an oxide derivative thereof, the water-soluble chromium compound (B) does not contain hexavalent chromium, and the pH is from 0.7 to 6.0; and a method for producing an Sn-based surface-treated steel sheet with high corrosion resistance and excellent paint adhesion, comprising coating the aqueous treating solution on the surface of an Sn-based plated steel sheet and drying the steel sheet.

As described above, the aqueous treating solution of the present invention is substantially free of hexavalent chromium harmful to living bodies and environment and assured of excellent liquid stability, and the Sn-based plated steel sheet produced by coating and drying the aqueous treating solution of the present invention is excellent in both corrosion resistance and paint adhesion and has a very high utility from environmental and industrial aspects compared with conventional Pb-containing materials for automobile fuel tanks.

BEST MODE FOR CARRYING OUT THE INVENTION

The aqueous treating solution of the present invention is described in detail below.

The aqueous treating solution of the present invention comprises (A) an organic material, (B) a water-soluble chromium compound, (C) a water-dispersible silica, and water and has a pH of 0.7 to 6:0. The organic material (A) is at least one member selected from an oxy-acid with the numerical ratio of hydroxyl group/carboxyl group in one molecule being from 3/1 to 10/1, its lactone form and an oxide derivative thereof. The numerical ratio of hydroxyl group/carboxyl group is more preferably from 4/1 to 8/1, still more preferably 5/1. If the numerical ratio of hydroxyl group/carboxyl group is less than 3/1, the paint adhesion is worsened along with reduction in the amount of coordination bond thereof to Sn or deterioration of alkali dissolution resistance, whereas if it exceeds 10/1, paint adhesion is worsened along with reduction in the amount of coordination bond thereof to Sn and at the same time, gelling of the aqueous treating solution or deterioration of coatability on a steel sheet surface due to increased viscosity may disadvantageously occur.

The organic material (A) preferably has a carbon number of 4 to 12. If the carbon number is less than 4, an organic material satisfying the hydroxyl group/carboxyl group ratio of the present invention and enabling stable use in industry is not present, whereas if the carbon number exceeds 12, the hydrophobic group moiety increases in the organic compound to allow the hydrophobic group to be unevenly distributed and aggregate with each other in the process of forming a film, leading to easy occurrence of cracking, and therefore, paint adhesion tends to deteriorate.

The organic material (A) with the numerical ratio of hydroxyl group/carboxyl group in one molecule being from 3/1 to 10/1, for use in the present invention, is not particularly limited but includes sugar acids and carboxyl group-containing phenols. The sugar acids as used in the present invention indicate a compound obtained by converting a sugar group into a functional group through oxidation, esterification or the like and mean a compound containing 1 or more carboxyl groups and 3 or more hydroxyl groups in one molecule.

Specific examples thereof include gluconic acid, ascorbic acid, erythronic acid, threonic acid, ribonic acid, arabinoic acid, xylonic acid, lyxonic acid, allonic acid, altronic acid, mannonic acid, gulonic acid, idonic acid, galactonic acid, talonic acid, and a derivative thereof. Specific examples of the carboxyl group-containing phenols include shikimic acid and quinic acid. Also, a lactone form and a derivative such as ester, phosphoric acid ester and ascorbyl-2-glucoside, which can take the above-described hydroxyl group/carboxyl group ratio resulting from dissociation of the bond in an aqueous solution, are also included.

The organic material (A) for use in the present invention is more preferably an aliphatic compound having no aromatic ring, still more preferably a compound belonging to the group of sugar acids above. Of the organic materials (A), an aliphatic compound as represented by sugar acids more readily forms a complex with Sn than an aromatic compound and is excellent in the alkali resistance, and in turn, excellent paint adhesion tends to result. Among these sugar acids, an ascorbic acid and a derivative or oxide thereof are preferred, and the organic material (A) for use in the present invention preferably contains at least one or more members thereof. The ascorbic acid is usually known as a lactone form and is most useful in the present invention, because when ring-opened, the hydroxyl group/carboxyl group numerical ratio becomes 5/1, i.e., the proportion of hydroxyl group becomes highest among sugar groups, indicating that formation of a complex with Sn most readily occurs, and at the same time, this compound is industrially available. In the case where the objective to be plated is a Zn system, a complex with Zn must have been formed, but the coordination force is small as compared with the Sn complex due to difference in the atomic radius and the effect of enhancing the paint adhesion is low. It can be said that a synergistic effect is obtained by the combination of Sn-based plating and ascorbic acid.

The blending amount of the organic material (A) for use in the present invention is, in terms of molar ratio to Cr in the water-soluble chromium compound (B), (A)/(B)=from 0.01 to 0.80, preferably from 0.03 to 0.60, more preferably from 0.05 to 0.5. If the blending amount is less than 0.01, the effect of enhancing the paint adhesion is not obtained, whereas if it exceeds 0.8, the film obtained comes to have poor water resistance and particularly, secondary adhesion to the coating film deteriorates.

The component (B) in the aqueous treating solution of the present invention is a water-soluble chromium compound and is substantially free of hexavalent chromium. The term "substantially free of hexavalent chromium" as used herein means that hexavalent chromium is not detected by the calorimetric method using diphenyl carbazide, which is generally known as a quantitative determination method for hexavalent chromium. The aqueous treating solution of the present invention contains a chromium compound except for hexavalent chromium, and the solution is colored by such a compound. In order to reduce the coloration effect, the solution is adjusted to a total chromium concentration of 200 ppm and assuming that 0.1 ppm in the analysis result here is the confidence limit, the hexavalent chromium content is made as low as less than 0.1 ppm.

The water-soluble chromium compound (B) may be sufficient as long as it is a chromium compound substantially free of hexavalent chromium, and is not particularly limited, but examples thereof include a trivalent chromium compound such as chromium biphosphate, chromium fluoride, chromium nitrate and chromium sulfate. Also, those obtained by dissolving chromic anhydride in water to prepare a hexavalent chromium-containing aqueous solution and adding thereto starch, sugars, alcohols, an organic material such as those described for the organic material (A) of the present invention, or a compound having a reducing activity, such as hydrogen peroxide, hydrazine, phosphorous acid and iron(II) sulfate, thereby reducing the hexavalent chromium, may be used.

The component (C) in the aqueous treating solution of the present invention is a water-dispersible silica. Regarding water-dispersible silica, for example, various kind of Snowtex (registered trademark, produced by Nissan Chemicals Industries, Ltd.) may be used. Although not particularly limited, examples of the spherical silica include Snowtex C, Snowtex CS, Snowtex CM, Snowtex O, Snowtex OS, Snowtex OM, Snowtex NS, Snowtex N, Snowtex NM, Snowtex S, Snowtex 20, Snowtex 30 and Snowtex 40, and examples of the chain silica include Snowtex UP, Snowtex OUP, Snowtex PS-S, Snowtex PS-SO, Snowtex PS-M, Snowtex PS-MO, Snowtex PS-L and Snowtex PS-LO. A dispersion of vapor-phase silica readily precipitates in the treating solution and is not preferred.

The weight ratio of the component (C) blended in the aqueous treating solution of the present invention to the metal in terms of Cr in the water-soluble chromium compound (B) is preferably $SiO_2$/Cr=from 0.5/1 to 6/1. If the weight ratio is less than 0.5, this component less contributes to the corrosion resistance and paint adhesion, whereas if it exceeds 6/1, the effect is saturated. With regard to water-dispersible silica used in the aqueous treating solution of the present invention, one or more chain silica and one or more spherical silica are preferably mixed and used. As for the chain silica/spherical silica ratio, the weight ratio in terms of $SiO_2$ is preferably chain silica/spherical silica=from 8/2 to 2/8, more preferably from 6/4 to 4/6. If the weight ratio of chain silica/spherical silica exceeds 8/2, the alkali resistance tends to deteriorate, whereas if it is less than 2/8, sufficient paint adhesion cannot be obtained.

The pH of the aqueous treating solution of the present invention is preferably from 0.7 to 6.0, more preferably from 0.8 to 2.0, still more preferably from 1.0 to 1.8. The acid added for the adjustment of pH is not particularly limited, but a strong acid which can adjust the pH in a small amount is preferred and examples thereof include nitric acid, sulfuric acid and phosphoric acid. Also, the alkali for elevating the pH includes ammonium salts such as ammonia and ammonium carbonate, amine compounds such as diethanolamine and triethylamine, and guanidyl compounds such as guanidine carbonate. If the pH of the aqueous treating solution of the present invention is less than 0.2, the etching action intensifies and poor processability results due to generation of hydrogen on the plating surface, whereas if pH exceeds 6.0, the oxide film on the plated Sn surface is insufficiently removed and at the same time, the liquid stability decreases.

The aqueous treating solution of the present invention preferably contains (D) a phosphoric acid and/or a phosphoric acid compound as an additional component. Examples thereof include orthophosphoric acid, metaphosphoric acid, pyrophosphohric acid, and their ammonium salts, amine salts and chromium biphosphates. By virtue of containing phosphoric acid and/or a phosphoric acid compound in the aqueous treating solution of the present invention, the corrosion resistance is enhanced. The mass ratio of the phosphoric acid and/or phosphoric acid compound (D) to the metal in terms of Cr in the water-soluble chromium compound (B) is preferably $PO_4$/Cr=from 1/1 to 3/1, more preferably $PO_4$/Cr=from 1/1 to 2/1. If the mass ratio is less than 1/1, the effect of enhancing the corrosion resistance is not obtained, and if it exceeds 3/1, paint adhesion may deteriorate.

The aqueous treating solution of the present invention preferably further contains (E) a metal salt as an additional component for the purpose of more enhancing the corrosion resistance, and the metal is preferably at least one metal selected from the group consisting of Mg, Ca, Sr, Ba, Co, Ni, Zr, W and Mo. More preferably, the metal salt is an Ni and/or Co salt and the weight ratio in terms of metal is metal/Cr=from 0.01/1 to 0.5/1, and still more preferably, the metal salt is a nitrate and the weight ratio is metal/Cr=from 0.05/1 to 0.4/1. If the weight ratio is less than 0.01/1, the effect of enhancing the corrosion resistance is not obtained, whereas if it exceeds 0.5/1, the effect is saturated.

In the treating solution of the present invention, phosphonic acid or a phosphonic acid compound may be additionally blended for more enhancing the adhesion between plating surface and film. The phosphonic acid compound is not particularly limited but includes a chelating agent having one or more phosphonic acid group or salt thereof, such as methyl diphosphonate, methylene phosphonate, ethylidene diphosphonate, and their ammonium salts and alkali metal salts. The oxidation product thereof include, out of such phosphonic acid-based chelating agents, those having a nitrogen atom in the molecule and being oxidized into an N-oxide form.

In the treating solution of the present invention, a water-soluble resin may be blended as an additional component for enhancing the corrosion resistance and paintability. The water-soluble resin is not particularly limited, but a water-soluble acrylic resin or copolymer generally employed for this purpose is preferably used within the range not affecting the liquid stability.

The plated steel sheet which is to be surface-treated with the treating solution of the present invention includes an Sn or Sn alloy plated steel sheet such as electro-tin-plated steel sheet called tinplate, electro-Sn—Zn-plated steel sheet and hot-dip Sn—Zn-plated steel sheet. A steel sheet having formed thereon an Sn-based plating layer comprising from 1 to 8.8 mass % of Zn and from 91.2 to 99.0 mass % of Sn is more preferred. The purpose of adding Zn is to impart a sacrificial corrosion protection action to the plating layer. The tin-zinc alloy plating is applied mainly to protect the steel sheet by the coating of tin (standard potential: EO=−0.14 V) which is an electrochemically noble metal, and imparts a sacrificial corrosion protection ability by the addition of zinc (standard potential: EO=−1.245 V) which is a base metal. If the amount of Zn added is less than 1 mass %, a sufficiently high sacrificial corrosion protection ability may not be imparted, whereas if the amount of Zn is increased, generation of white rust attributable to Zn increases. When Zn exceeds the eutectic point of 8.8%, white rust appears significantly, and this point is preferably taken as the upper limit value. Examples of the impurity elements include a trace amount of Fe, Ni, Co or Pb. The effect of enhancing the corrosion resistance is obtained also by the addition of Mg. If desired, Al, misch metal, Sb or the like may be further added.

The production method of the Sn-based plated steel sheet is not particularly specified, but a hot-dip plating method is preferred in that thick plating is easily achieved. The hot-dip plating process includes a Sendzimir process and a flux process, and either production method may be used. In order to obtain good appearance by Sn-based plating with a high Sn composition, Ni- or Co-based pre-plating is preferably applied. By this pre-plating, good plating without plating failure is facilitated. In particular, when Ni—Fe pre-plating is applied, an Sn dendrite texture preventing the thickening of Zn at the Sn-based plating spangle boundary is formed and therefore, excellent corrosion resistance is obtained. At this time, an Ni, Co or Fe plating layer, an intermetallic compound layer of Sn or Mg containing such a metal as above, or a layer comprising a composite of both is produced at the interface between the Sn-based plating layer and the basis metal. The thickness of this layer is not particularly limited, but is usually 1 μm or less.

The Sn-based plating coverage affects the properties and production cost. The coverage is of course preferably larger for corrosion resistance and is preferably smaller in view of spot weldability and cost. The coverage for balancing these is approximately from 5 to 100 g/m$^2$ per one surface, and a coverage in this range is preferred. For example, in the case where corrosion resistance is not so much required as in home appliances, the coverage is inferably smaller, and in usage for an automobile fuel tank where the corrosion resistance is important, the coverage is preferably larger.

By virtue of coating with tin having excellent corrosion resistance, the plated steel sheet above is excellent in corrosion resistance compared with a zinc-based plated steel sheet, but on the other hand, tin oxide (SnO, $SnO_2$) produced on the Sn surface occupying a majority of the plating surface during production or natural standing is brittle and has a low wettability and this gives rise to insufficient adhesion between plating and paint. However, the treating solution of the present invention appropriately etches tin oxide on the plating surface to create a newborn metal plating surface and after coating and drying, forms a composite film comprising an organic acid having a Cr-silica specific structure directly bonded to the plating metal, so that a surface-treated Sn-based plated steel sheet with good corrosion resistance and excellent paint adhesion can be provided.

As for the treating method using the aqueous treating solution of the present invention, it may be sufficient if the aqueous treating solution of the present invention is coated on the surface of a plated steel sheet and dried under heating, and the coating method, the drying method and the like are not particularly limited. Usually, there may be used a roll coating method of coating the treating solution on the base material surface by roll transfer, or a method of wetting the base metal surface by showering or dipping and removing the excess treating solution by roll squeezing or air knife to adjust the coated amount. At this time, the temperature of the aqueous treating solution is not particularly limited, but the treating temperature is preferably from 5 to 60° C.

The drying temperature after coating the aqueous treating solution of the present invention is, in terms of the maximum peak sheet temperature, preferably from 50 to 200° C. The heating method is not particularly limited, and any method such as hot air, open fire, induction heat, infrared ray, near infrared ray and electric furnace may be used. The film amount after drying is, in terms of the weight of Cr, preferably from 3 to 100 mg/m$^2$, more preferably from 4 to 80 mg/m$^2$, still more preferably from 5 to 40 mg/m$^2$. If the film amount after drying is less than 3 mg/m$^2$, the effect of enhancing the corrosion resistance is poor, whereas if it exceeds 100 mg/m$^2$, cracking or the like may readily occur in the film itself and the paint adhesion decreases.

The activity of each component in the treating solution of the present invention is described below.

Detailed studies by the present invention have revealed that the organic material (A) for use in the present invention is expected to provide the following effects. First, this component contributes to liquid stability as the treating solution. In the oxy-acid with the ratio of hydroxyl group/carboxyl group in one molecule being from 3/1 to 10/1, at least one pair of carboxyl group and hydroxyl group strongly coordinate to a trivalent chromium ion and remaining two or more hydroxyl groups exhibit hydrophilicity, so that the trivalent chromium ion can be prevented from self-condensation reaction in liquid with the passing of time and the stability of treating solution can be enhanced. Also, in the oxy-acid with the ratio of hydroxyl group/carboxyl group in one molecule being from 3/1 to 10/1, at least one pair of carboxyl group and hydroxyl group strongly coordinate selectively to Sn on the plating surface, so that after the coating and drying on an Sn-based plated steel sheet, firm adhesion to the plating surface can be developed. In addition, this component compositely effects crosslinking also with trivalent chromium and silica to allow film formation with the progress of polymer growth and brings about enhancement in the corrosion resistance of film as well as in the paint adhesion by virtue of intensified bonding with a paint.

The organic material A which is chained, such as sugar acids, is less susceptible to steric restriction than the planar structure having an aromatic ring, and this is advantageous for coordination to Sn. Furthermore, it is considered that the bonding in the film involves dehydrating condensation and assumes a covalent bond character and therefore, a film excellent in the water resistance and corrosion resistance is formed.

On the other hand, in the case of an organic material having only a carboxyl group, for example, in chromium acetate, where the molar ratio of acetic acid/Cr(III) is 3 or more, liquid stability is ensured. In the treatment of a plated steel sheet, the carboxyl group of the acetic acid is considered to mostly remain in the film after coating and drying. In the film, the carboxyl group is merely forming an electrostatic bond to Cr or plating metal and therefore, the bond is readily broken at the treatment with an acid or an alkali or at the localized acid/alkali reaction during the progress of corrosion. Also, this material readily dissolves due to its small molecular weight, and therefore, paint adhesion and corrosion resistance are poor.

In the usual chromate film, polyacrylic acids are added for the purpose of enhancing adhesion, but since the polyacrylic acids are a polymer, the number of bonding points in one molecule is large and breakage of all bonds can be hardly achieved. Accordingly, the dissolving out property is low and the above-described defect seems to less appear. However, crosslinking readily occurs even in an aqueous solution and depending on the amount added, the treating solution may be gelled. The polyacrylic acids may be used for the purpose of enhancing the paint adhesion by the addition in a small amount but cannot be used for enhancing the liquid stability as the counter ion of trivalent chromium.

Even when the organic material has both a hydroxyl group and a carboxyl group, if the hydroxyl group/carboxyl group ratio is 2/1 or less, for example, in the case of lactic acid, tartaric acid, glyceric acid or citric acid, not only the coordination force to Sn decreases from the reason of steric structure with the carboxyl group and hydroxyl group in the film but also the alkali resistance is low and the paint adhesion is poor. Conversely, if the hydroxyl group/carboxyl group ratio exceeds 10/1, the coordination force to Sn and in turn the paint adhesion are decreased and at the same time, increase in the viscosity and deterioration of coatability tend to result due to three-dimensional interaction of the excess hydroxyl group.

In the treating solution of the present invention, the water-dispersible silica (C) is indispensable and by virtue of this component, the corrosion resistance can be enhanced. Also, by using two or more kinds of water-dispersible silicas differing in the shape, both paint adhesion and alkali resistance can be satisfied. The effect of water-dispersible silica on the film differs between the spherical silica and the chain silica, and therefore, two or more kinds of these silicas are preferably mixed. More specifically, individual particles of spherical silica are a truly spherical particle in a size of approximately from several nm to several hundreds nm and when a film is formed from the liquid dispersion thereof, the particles can be densely overlapped to form a smooth film having a small specific surface area. On the other hand, the chain silica is a particle resulting from spherical or oval silica being connected like a chain on the order of several hundreds nm and when a film is formed from the liquid dispersion of this chain silica, the particles in the chain state are directly overlapped, so that an uneven film having a high specific surface area can be formed.

Actually, when a film was formed on the steel sheet surface by using chain silica in the treating solution of the present invention, an uneven film was formed by the effect of chain silica and this was very effective for the enhancement of paint adhesion. However, when the chain silica was used alone in the treating solution of the present invention, the alkali resistance was decreased. The reduction in alkali resistance means that when the steel sheet of the present invention is washed with an alkaline solution (alkali degreasing), the chrome as a film component becomes to readily dissolve out. This phenomenon was found in the process of studying the present invention.

On the other hand, when spherical silica was used alone in the treating solution of the present invention, a dense film with less irregularities and a small specific surface area was formed and this film was excellent in the alkali resistance, but the anchor effect was low due to less irregularities and the paint adhesion was decreased as compared with chain silica. In other words, a film with less irregularities and a small specific surface area is excellent in the alkali resistance but exhibits poor paint adhesion, and a film with many irregularities and a large specific surface area is inferior in the alkali resistance but exhibits excellent paint adhesion. Accordingly, in order to satisfy both the paint adhesion and the alkali resistance, in the present invention, one or more kinds of chain silica and one or more kinds of spherical silica are preferably combined at a weight ratio of chain silica/spherical silica=from 2/8 to 8/2 in terms of $SiO_2$.

The phosphoric acid or phosphate compound (D) in the treating solution of the present invention forms a three-dimensional insoluble salt with the trivalent chromium after coating and drying and is considered to be effective in enhancing the corrosion resistance.

The metal salt (E) in the treating solution of the present invention provides; when combined with silica, an effect of enhancing the corrosion resistance. In particular, on the Zn-containing plating surface, this component promotes production of basic zinc chloride or basic zinc carbonate capable of suppressing the corrosion and therefore, wastage of zinc due to corrosion can be reduced.

EXAMPLES

The present invention is described in greater detail below by referring to Examples and Comparative Examples.

Incidentally, these Examples are set forth to facilitate understanding of the present invention, but are not intended limit the scope of the present invention.

[Preparation of Sheet for Test]

(1) Test Specimen

Production of Hot-Dip Sn-Based Plated Steel Sheet

A steel having components shown in Table 1 was melted by a normal steel converter-vacuum degassing process to form a slab, and this slab was hot-rolled, cold-rolled and then continuously annealed under normal conditions to obtain an annealed steel sheet (sheet thickness: 0.8 mm). After applying Fe—Ni plating of 0.2 g/m$^2$ to a part of the resulting steel sheet, Sn-based plating was performed by a flux method. As for the Fe—Ni alloy plating bath, an Ni plating Watt bath having added thereto from 30 to 200 g/L of iron sulfate was used. The flux was used by roll-coating it with an aqueous $ZnCl_2$ solution, and the Zn composition in the plating bath was changed in the range from 0 to 20 wt %. The bath temperature was set to 280° C. and after plating, the plating coverage was adjusted by gas wiping. The surface roughness degree of the thus-produced plated steel sheet was then adjusted by temper-rolling with a roll having various roughness degrees.

Production of Hot-Dip Zn-Based Plated Steel Sheet

Similar to the production example of hot-dip Sn-based plated steel sheet, a steel having components shown in Table 1 was melted by a normal steel converter-vacuum degassing process to form a slab, and this slab was hot-rolled, acid-washed in 10% hydrochloric acid and then cold-rolled under normal conditions to obtain a cold-rolled steel sheet having a sheet thickness of 0.8 mm. This cold-rolled steel sheet was annealed at a soaking temperature of 800° C. for a soaking time of 20 seconds, cooled to 465° C. at a cooling rate of 20° C./sec and then dipped in a Zn-0.2% Al plating bath at a bath temperature of 460° C. for 3 seconds, and the coverage was adjusted to 40 to 50 g/m$^2$ by wiping.

The obtained steel sheet was subjected to several kinds of post-treatments. The kind and composition of the post-treatment are shown in Table 2.

TABLE 1

| Component Composition of Original Sheet | | | | | | | | | |
|---|---|---|---|---|---|---|---|---|---|
| Chemical Component Composition (mass %) | | | | | | | | | |
| C | Si | Mn | P | S | Ti | Nb | Al | B | N |
| 0.0022 | 0.08 | 0.31 | 0.008 | 0.01 | 0.033 | 0.001 | 0.05 | 0.0005 | 0.0031 |

TABLE 2

| Organic Materials Used in Examples and Comparative Examples | | | | | | |
|---|---|---|---|---|---|---|
| | Organic Material | Carbon Number | Number of Carboxyl Groups in One Molecule | Number of Hydroxyl Groups in One Molecule | Hydroxyl Group/ Carboxyl Group | Class of Compound |
| A1 | chlorogenic acid | 16 | 1 | 5 | 5 | aromatic |
| A2 | gallic acid | 7 | 1 | 3 | 3 | aromatic |
| A3 | erythronic acid | 4 | 1 | 3 | 3 | aliphatic (sugar acids) |
| A4 | lyxonic acid | 5 | 1 | 4 | 4 | aliphatic (sugar acids) |
| A5 | ascorbic acid | 6 | 1 | 5 | 5 | sugar acids (lactone form) |
| A6 | ascorbyl-2-glucoside | 12 | 1 | 7 | 7 | ascorbic acid derivative |
| A7 | acetic acid | 2 | 1 | 0 | 0 | organic acid (mono-valent) |
| A8 | lactic acid | 3 | 1 | 1 | 1 | oxy-acid |
| A9 | tartaric acid | 4 | 2 | 2 | 1 | oxy-acid |
| A10 | citric acid | 6 | 3 | 1 | 0.33 | oxy-acid |

Here, in all of the post-treated films, the same treatment was applied to both surfaces. In the terne metal sheet for comparison, the same annealed sheet (sheet thickness: 0.8 mm) as above was also used. After applying Ni plating of 1 g/m$^2$ to a part of this steel sheet, Pb—Sn plating was performed by a flux method. The flux was used by roll-coating it with an aqueous $ZnCl_2$ solution, and the Sn composition in the plating bath was set to 8%. The bath temperature was set to 350° C. and after plating, the plating coverage was adjusted by gas wiping. Thereafter, the steel sheet was dipped in a 10 g/L phosphoric acid solution and used for the test.

(2) Degreasing Treatment

The test specimens prepared above each was subjected to a degreasing treatment (concentration: 20 g/L, temperature: 60° C., spraying for 20 seconds) with a silicate-based alkali degreasing agent, Fine Cleaner 4336 (registered trademark, produced by Nihon Parkerizing Co., Ltd.), and then washed with tap water.

(3) Preparation of Surface Treating Solution of the Present Invention

The organic materials are shown in Table 2, the water-soluble chromium compounds are shown in Table 3, the water-dispersible silicas are shown in Table 4, the phosphoric acid and compounds thereof are shown in Table 5, and nitrate metal salts are shown in Table 6. In Example Nos. 1 to 33 and Comparative Example Nos. 34 to 49 (excluding Comparative Example Nos. 42 and 43) shown in Table 7, it was confirmed that hexavalent chromium was not substantially contained. Here, "30% reduced chromium" was obtained by dissolving chromic acid anhydride in pure water and adding methanol to reduce the hexavalent chromium to 30%. Also, "100% reduced chromium" was obtained by adding the components (the water-dispersible silica was added later) to the 30% reduced chromium to give the composition shown in Table 7, adjusting the pH with nitric acid and aqueous ammonia, and adding hydrazine monohydrate ($NH_2NH_2.H_2O$) until hexavalent chromium was not detected.

The components were mixed and dissolved to give the composition shown in Table 7, and the pH was adjusted using nitric acid and aqueous ammonia. The water-dispersible silica was added after the adjustment of pH, and the concentration was adjusted with pure water to 1 wt % in terms of Cr concentration, whereby an aqueous treating solution was prepared.

TABLE 3

| Water-Soluble Chromium Compounds Used in Examples and Comparative Examples | |
|---|---|
| B1 | chromium fluoride |
| B2 | chromium phosphate |
| B3 | chromium nitrate |
| B4 | 100% reduced chromium |
| B5 | chromium acetate |
| B6 | 30% reduced chromium |

TABLE 4

| Water-Dispersible Silicas Used in Examples and Comparative Examples | | |
|---|---|---|
| C1 | Snowtex O | spherical silica |
| C2 | Snowtex PS-SO | chain silica |
| C3 | Snowtex PS-MO | chain silica |
| C4 | water dispersion of Aerosil 200 | vapor-phase silica |
| C5 | sodium metasilicate | silicate |

TABLE 5

| Phosphoric Acid and Phosphoric Acid Compound Used in Examples and Comparative Examples | |
|---|---|
| D1 | 75% phosphoric acid |
| D2 | aqueous ammonium dihydrogenphosphate solution |

TABLE 6

| Metal Salts Used in Examples and Comparative Examples | |
|---|---|
| E1 | cobalt nitrate hexahydrate |
| E2 | nickel nitrate hexahydrate |

TABLE 7

Surface Treating Solution Used in Examples and Comparative Examples

| | (A) Organic Material | | (B) Water-Soluble Chromium Compound | | (C) Water-Dispersible Silica | | |
|---|---|---|---|---|---|---|---|
| No. | Compound | (A)/(B) by mol | Compound | wt % (as Cr) | Compound | $SiO_2$/Cr | Chain/ Spherical (by weight) |
| 1 | A1 | 0.1 | B3 | 1 | C1 | 4 | 0/1 |
| 2 | A2 | 0.1 | B3 | 1 | C1 | 4 | 0/1 |
| 3 | A3 | 0.1 | B3 | 1 | C1 | 4 | 0/1 |
| 4 | A4 | 0.1 | B3 | 1 | C1 | 4 | 0/1 |
| 5 | A5 | 0.1 | B3 | 1 | C1 | 4 | 0/1 |
| 6 | A6 | 0.1 | B3 | 1 | C1 | 4 | 0/1 |
| 7 | A5 | 0.03 | B3 | 1 | C1 | 4 | 0/1 |
| 8 | A5 | 0.05 | B3 | 1 | C1 | 4 | 0/1 |
| 9 | A5 | 0.5 | B3 | 1 | C1 | 4 | 0/1 |
| 10 | A5 | 0.7 | B3 | 1 | C1 | 4 | 0/1 |
| 11 | A5 | 0.6 | B1 | 1 | C1 | 4 | 0/1 |
| 12 | A5 | 0.5 | B1 + B2 | 0.8 + 0.2 | C1 | 4 | 0/1 |
| 13 | A5 | 0.5 | B2 + B3 | 0.5 + 0.5 | C1 | 4 | 0/1 |
| 14 | A5 | 0.5 | B2 + B3 | 0.5 + 0.5 | C1 | 0.6 | 0/1 |
| 15 | A5 | 0.5 | B2 + B3 | 0.5 + 0.5 | C1 | 2 | 0/1 |
| 16 | A5 | 0.5 | B2 + B3 | 0.5 + 0.5 | C1 | 5.5 | 0/1 |
| 17 | A5 | 0.5 | B2 + B3 | 0.5 + 0.5 | C2 | 5.5 | 1/0 |
| 18 | A5 | 0.4 | B4 | 1 | C1 | 4 | 0/1 |
| 19 | A5 | 0.4 | B4 | 1 | C3 | 4 | 1/0 |
| 20 | A5 | 0.5 | B3 | 1 | C1 + C3 | 1 + 3 | 3/1 |
| 21 | A5 | 0.4 | B4 | 1 | C1 + C3 | 1 + 3 | 3/1 |
| 22 | A5 | 0.4 | B4 | 1 | C1 + C3 | 1.4 + 2.6 | 2.6/1.4 |
| 23 | A5 | 0.4 | B4 | 1 | C1 + C3 | 2.6 + 1.4 | 1.4/2.6 |
| 24 | A5 | 0.4 | B4 | 1 | C1 + C3 | 3 + 1 | 1/3 |
| 25 | A5 | 0.4 | B4 | 1 | C1 + C3 | 1 + 3 | 3/1 |
| 26 | A5 | 0.4 | B4 | 1 | C1 + C3 | 2 + 2 | 2/2 |
| 27 | A5 | 0.5 | B3 | 1 | C1 + C3 | 1 + 3 | 3/1 |
| 28 | A5 | 0.3 | B1 | 1 | C1 + C3 | 1 + 3 | 3/1 |
| 29 | A5 | 0.4 | B4 | 1 | C1 + C3 | 1 + 3 | 3/1 |
| 30 | A5 | 0.4 | B4 | 1 | C1 + C3 | 1 + 3 | 3/1 |
| 31 | A5 | 0.4 | B4 | 1 | C1 + C3 | 1 + 3 | 3/1 |
| 32 | A5 | 0.4 | B4 | 1 | C1 + C3 | 1 + 3 | 3/1 |
| 33 | A5 | 0.4 | B4 | 1 | C1 + C3 | 1 + 3 | 3/1 |
| 34 | A6 | 0.3 | B3 | 1 | C1 | 4 | 0/1 |
| 35 | A7 | 0.3 | B3 | 1 | C1 | 4 | 0/1 |
| 36 | A8 | 0.3 | B3 | 1 | C1 | 4 | 0/1 |
| 37 | A8 | 0.3 | B3 | 1 | none | — | — |
| 38 | A8 | 0.3 | B3 | 1 | C1 | 4 | 0/1 |
| 39 | A9 | 0.3 | B4 | 1 | C1 | 4 | 0/1 |
| 40 | none | — | B3 | 1 | C1 | 4 | 0/1 |
| 41 | A5 | 0.3 | B5 | 1 | C1 | 2 | 0/1 |

TABLE 7-continued

| Surface Treating Solution Used in Examples and Comparative Examples | | | | | | | |
|---|---|---|---|---|---|---|---|
| 42 | A5 | 0.3 | B6 | 1 | C1 | 3.5 | 0/1 |
| 43 | A5 | 0.3 | B6 | 1 | C2 | 3.5 | 1/0 |
| 44 | A5 | 0.3 | none | 1 | C1 | 3.5 | 0/1 |
| 45 | A4 | 0.3 | B3 | 1 | C4 | 4 | — |
| 46 | A4 | 0.3 | B3 | 1 | C5 | 4 | — |
| 47 | A5 | 0.3 | B4 | 1 | none | — | — |
| 48 | A5 | 0.3 | B3 | 1 | C1 | 2 | 0/1 |
| 49 | A5 | 0.3 | B5 | 1 | C1 | 2 | 0/1 |

| | (D) Phosphoric Acid Compound | | (E) Metal Salt | | | |
|---|---|---|---|---|---|---|
| No. | Compound | Weight Ratio (as $PO_4$) | Compound | Metal/Cr, by weight | pH $Cr^{6+}$ | Remarks |
| 1 | — | — | — | — | 1.8 free | Invention |
| 2 | — | — | — | — | 1.8 free | |
| 3 | — | — | — | — | 1.3 free | |
| 4 | — | — | — | — | 1.9 free | |
| 5 | — | — | — | — | 1.2 free | |
| 6 | — | — | — | — | 1.9 free | |
| 7 | — | — | — | — | 2.0 free | |
| 8 | — | — | — | — | 1.9 free | |
| 9 | — | — | — | — | 1.8 free | |
| 10 | — | — | — | — | 2.0 free | |
| 11 | — | — | — | — | 1.9 free | |
| 12 | — | 1.1/1 | — | — | 1.8 free | |
| 13 | — | 2.7/1 | — | — | 1.9 free | |
| 14 | — | 2.7/1 | — | — | 1.9 free | |
| 15 | — | 2.7/1 | — | — | 1.7 free | |
| 16 | — | 2.7/1 | — | — | 1.9 free | |
| 17 | — | 2.7/1 | — | — | 1.9 free | |
| 18 | D1 | 2.0/1 | — | — | 1.6 free | |
| 19 | D1 | 2.0/1 | — | — | 1.6 free | |
| 20 | D1 | 2.8/1 | — | — | 1.9 free | |
| 21 | D1 | 2.0/1 | — | — | 1.6 free | |
| 22 | D1 | 2.0/1 | — | — | 1.6 free | |
| 23 | D1 | 2.0/1 | — | — | 1.6 free | |
| 24 | D1 | 2.0/1 | — | — | 1.6 free | |
| 25 | D2 | 2.5/1 | — | — | 1.8 free | |
| 26 | D2 | 2.5/1 | — | — | 1.8 free | |
| 27 | D1 | 3.5/1 | — | — | 1.7 free | |
| 28 | D1 | 1.5/1 | E1 | 0.2 | 1.6 free | |
| 29 | D2 | 2.5/1 | E2 | 0.2 | 1.8 free | |
| 30 | D1 | 1.5/1 | E1 | 0.2 | 1.4 free | |
| 31 | D1 | 1.5/1 | E1 | 0.6 | 1.4 free | |
| 32 | D1 | 1.5/1 | E1 | 0.2 | 0.7 free | |
| 33 | D1 | 1.5/1 | E1 | 0.2 | 6.0 free | |
| 34 | — | — | — | — | 2.0 free | Comparative |
| 35 | — | — | — | — | 1.8 free | Example |
| 36 | — | — | — | — | 1.5 free | |
| 37 | — | — | E1 | 0.3 | 1.5 free | |
| 38 | — | — | E1 | 0.3 | 1.5 free | |
| 39 | — | — | — | — | 1.5 free | |
| 40 | — | — | — | — | 1.5 free | |
| 41 | D1 | 1.5/1 | E1 | 0.3 | 1.6 free | |
| 42 | D1 | 1.5/1 | E1 | 0.3 | 1.6 containing | |
| 43 | D1 | 1.5/1 | E1 | 0.3 | 1.6 containing | |
| 44 | D1 | 1.5/1 | E1 | 0.3 | 1.6 free | |
| 45 | — | — | — | — | 1.8 free | |
| 46 | — | — | — | — | 6.5 free | |
| 47 | D1 | 1.5/1 | E1 | 0.3 | 1.6 free | |
| 48 | D2 | 2.0/1 | — | — | 0.6 free | |
| 49 | D2 | 2.7/1 | — | — | 2.5 free | |

Note)

In Nos. 12 to 17, the weight ratio as $PO_4$ is shown despite no addition of the phosphoric acid compound (D) and this is because phosphoric acid is contained in the water-soluble chromium compound (B).

(4) Coating of Surface Treating Solution

The surface treating solutions prepared above each was coated on each test specimen by a bar coater and dried at an ambient temperature of 240° C. Incidentally, the coverage was adjusted by appropriately controlling the solid content concentration. The Cr coverage (mg/m$^2$) was determined by the fluorescent X-ray analysis, and the average value in the ϕ30 mm area was employed.

[Items and Methods for Evaluation of Performance]

(1) Corrosion Resistance Test (Corrosion Resistance Test of Planar Part)

A salt spray test by JIS-Z-2371 was performed for 1,000 hours, and the red rust generation area was observed and evaluated according to the following criteria.

[Evaluation Criteria]

AA: The red rust generation area ratio was less than 3% of the entire area.

BB: The red rust generation area ratio was from 3% to less than 10% of the entire area.

CC: The red rust generation area ratio was from 10% to less than 30% of the entire area.

DD: The red rust generation area ratio was 30% or more of the entire area.

(2) Weldability

Spot welding was performed under the welding conditions shown below, and the number of continuous spots until the nugget diameter reached below $4\sqrt{t}$, was evaluated.

[Welding Conditions]

Electrode: dome-shape electrode, tip diameter of 6 mm

Welding current: 95% of the current causing generation of dusts

Pressure applied: 200 kg

Preliminary pressurization: 50 cycles

Electrification: 10 cycles

Hold: 3 cycles

[Evaluation Criteria]

AA: More than 300 continuous spots.

BB: From 200 to 300 continuous spots.

CC: From 100 to 200 continuous spots.

DD: Less than 100 continuous spots.

(3) Paint Adhesion

A phthalic acid resin-based paint was coated on the test specimen by using a bar coater and dried under heating at 120° C. for 20 minutes to obtain a dry film thickness of 20 μm. Subsequently, the test specimen was dipped in boiling water for 30 minutes, taken out and then allowed to stand for 24 hours. Thereafter, a crosscut treatment forming 100 squares of 1 mm was applied and after a tape peeling test, the number of residual squares was determined. The evaluation criteria of paint adhesion are shown below. The test was performed for 2 units of each test specimen.

[Evaluation Criteria]

AA: The number of residual squares is 100.

BB: The number of residual squares is from 98 to less than 100.

CC: The number of residual squares is from 50 to less than 98.

DD: The number of residual squares is less than 50.

(4) Treating Solution Stability

Each aqueous treating solution was kept at 30° C. in a hermetically-closed state. The evaluation criteria of treating solution stability are shown below.

[Evaluation Criteria]

AA: No gelling for 5 days or more.

BB: No gelling for 24 hours to less than 5 days.

CC: No gelling for 1 hour to less than 24 hours.

DD: Gelled in less than 1 hour.

(5) Long-Term Liquid Stability

Zinc carbonate of 2 g/L in terms of Zn was added to each aqueous treating solution, and the solution was kept at 40° C. for 1 week in a hermetically-closed state. The specimen was rated "good" when gelling or precipitate was not observed in the treating solution, and rated "bad" when observed.

(6) Alkali Resistance

The test specimen was subjected to a degreasing treatment (concentration: 20 g/L, temperature: 60° C., spraying for 20 seconds) with a silicate-based alkali degreasing agent, Fine Cleaner 4336 (registered trademark, produced by Nihon Parkerizing Co., Ltd.), then washed with tap water and dried in an oven for 10 minutes in an atmosphere of 80° C. The Cr coverage was measured by XRF before and after degreasing, the Cr fixing ratio was calculated from Cr coverage after degreasing/Cr coverage before degreasing. The evaluation criteria of Cr fixing ratio are shown below.

[Evaluation Criteria]

AA: Fixing ratio of 98 to 100%.

BB: Fixing ratio of 90 to 98%.

CC: Fixing ratio of 50 to 90%.

DD: Fixing ratio of less than 50%.

As apparent from Tables 7 and 8, the aqueous treating solution of the present invention exhibited excellent liquid stability, and the hot-dip Sn-based plated steel sheet produced by coating and drying the aqueous treating solution of the present invention was excellent in the corrosion resistance, paint adhesion, weldability and alkali resistance. On the other hand, as shown in Tables 7 and 8, in Comparative Examples, these performances could not be obtained in good balance. Also, the hot-dip Sn-based plated steel sheet produced by coating and drying the aqueous treating solution shown in Nos. 42 and 43 of Table 7 provided an effect comparable to that of Examples as shown in Table 8, but these aqueous treating solutions contain hexavalent chromium and are environmentally undesirable.

TABLE 8

Evaluation Results of Examples and Comparative Examples

| | | Aqueous Treating Solution | | | | | | Treating Solution Stability | | | |
|---|---|---|---|---|---|---|---|---|---|---|---|
| No. | Plating Species | Treating Solution No. | Cr Coverage (mg/m$^2$) | Maximum Peak Sheet Temperature (° C.) | Corrosion Resistance | Weldability | Paint Adhesion | Short Term | Long Term | Alkali Resistance | Remarks |
| 1 | Sn—8% Zn | No. 1 | 20 | 60 | BB | BB | BB | AA | good | BB | Invention |
| 2 | Sn—8% Zn | No. 2 | 20 | 60 | BB | BB | BB-AA | AA | good | BB | |
| 3 | Sn—8% Zn | No. 3 | 20 | 60 | BB | BB | BB-AA | AA | good | AA | |
| 4 | Sn—8% Zn | No. 4 | 20 | 60 | BB | BB | BB-AA | AA | good | AA | |

TABLE 8-continued

Evaluation Results of Examples and Comparative Examples

| No. | Plating Species | Aqueous Treating Solution: Treating Solution No. | Aqueous Treating Solution: Cr Coverage (mg/m$^2$) | Aqueous Treating Solution: Maximum Peak Sheet Temperature (° C.) | Corrosion Resistance | Weldability | Paint Adhesion | Treating Solution Stability: Short Term | Treating Solution Stability: Long Term | Alkali Resistance | Remarks |
|---|---|---|---|---|---|---|---|---|---|---|---|
| 5 | Sn—8% Zn | No. 5 | 20 | 60 | BB | BB | BB-AA | AA | good | AA | |
| 6 | Sn—8% Zn | No. 6 | 20 | 80 | BB | BB | BB-AA | AA | good | AA | |
| 7 | Sn—8% Zn | No. 2 | 50 | 60 | AA | BB | BB | AA | good | BB-CC | |
| 8 | Sn—8% Zn | No. 3 | 50 | 60 | AA | BB | BB | AA | good | BB | |
| 9 | Sn—8% Zn | No. 5 | 50 | 60 | AA | BB | BB-AA | AA | good | BB | |
| 10 | Sn—8% Zn | No. 7 | 20 | 80 | BB | BB | BB | AA | good | AA | |
| 11 | Sn—6% Zn | No. 8 | 20 | 80 | BB | BB | BB | AA | good | AA | |
| 12 | Sn—6% Zn | No. 9 | 20 | 80 | BB | BB | BB | AA | good | AA | |
| 13 | Sn—8% Zn | No. 10 | 20 | 80 | BB | BB | BB | AA | good | BB | |
| 14 | Sn—8% Zn | No. 11 | 20 | 120 | BB | BB | BB-AA | AA | good | BB-AA | |
| 15 | Sn—8% Zn | No. 12 | 20 | 120 | AA | BB | BB-AA | AA | good | AA | |
| 16 | Sn—8% Zn | No. 13 | 20 | 120 | AA | BB | BB-AA | AA | good | AA | |
| 17 | Sn—9% Zn | No. 14 | 20 | 120 | BB | BB | BB-AA | AA | good | AA | |
| 18 | Sn—8% Zn | No. 15 | 20 | 100 | AA | BB | BB-AA | AA | good | AA | |
| 19 | Sn—8% Zn | No. 16 | 20 | 100 | AA | BB | BB | AA | good | AA | |
| 20 | Sn—3% Zn | No. 17 | 20 | 100 | BB | BB | BB | AA | good | BB | |
| 21 | Sn—8% Zn | No. 18 | 20 | 80 | AA | BB | BB | AA | good | AA | |
| 22 | Sn—8% Zn | No. 19 | 20 | 80 | AA | BB | AA | AA | good | BB | |
| 23 | Sn—8% Zn | No. 20 | 20 | 100 | AA | BB | AA | AA | good | AA | |
| 24 | Sn—8% Zn | No. 21 | 20 | 80 | AA | BB | AA | AA | good | AA | |
| 25 | Sn—8% Zn | No. 22 | 20 | 80 | AA | BB | AA | AA | good | AA | |
| 26 | Sn—8% Zn | No. 23 | 20 | 80 | AA | BB | AA | AA | good | AA | |
| 27 | Sn—8% Zn | No. 24 | 20 | 80 | AA | BB | BB-AA | AA | good | AA | |
| 28 | Sn—9% Zn | No. 25 | 20 | 80 | AA | BB | AA | AA | good | AA | |
| 29 | Sn—8% Zn | No. 26 | 20 | 80 | AA | BB | AA | AA | good | AA | |
| 30 | Sn—8% Zn | No. 27 | 20 | 100 | AA | BB | BB | AA | good | BB | |
| 31 | Sn | No. 28 | 20 | 80 | BB | BB | AA | AA | good | AA | |
| 32 | Sn—3% Zn | No. 28 | 20 | 80 | AA | BB | AA | AA | good | AA | |
| 33 | Sn—8% Zn | No. 28 | 20 | 80 | AA | BB | AA | AA | good | AA | |
| 34 | Sn—20% Zn | No. 28 | 20 | 80 | BB | BB | AA | AA | good | AA | |
| 35 | Sn—45% Zn | No. 28 | 20 | 80 | BB | BB | AA | AA | good | AA | |
| 36 | Sn—8% Zn | No. 29 | 20 | 80 | AA | BB | AA | AA | good | AA | |
| 37 | Sn—8% Zn | No. 30 | 20 | 80 | AA | BB | AA | AA | good | AA | |
| 38 | Sn—8% Zn | No. 31 | 20 | 80 | AA | BB | BB-AA | AA | good | BB | |
| 39 | Sn—8% Zn | No. 30 | 3 | 80 | BB | BB | BB | AA | good | AA | |
| 40 | Sn—8% Zn | No. 30 | 5 | 80 | AA | BB | AA | AA | good | AA | |
| 41 | Sn—8% Zn | No. 30 | 40 | 80 | AA | BB | AA | AA | good | AA | |
| 42 | Sn—8% Zn | No. 30 | 60 | 80 | AA | BB | BB | AA | good | BB | |
| 43 | Sn—8% Zn | No. 32 | 5 | 80 | BB | BB | BB | AA | good | AA | |
| 44 | Sn—8% Zn | No. 33 | 5 | 80 | BB | BB | BB | BB | good | AA | |
| 45 | Sn—8% Zn | No. 34 | 20 | 100 | BB | BB | DD | AA | good | DD | Comparative |
| 46 | Sn—8% Zn | No. 35 | 20 | 100 | BB | BB | CC | DD | bad | CC | Example |
| 47 | Sn—8% Zn | No. 36 | 20 | 100 | BB | BB | CC | BB | good | CC | |
| 48 | Sn—8% Zn | No. 37 | 20 | 100 | CC | BB | CC | BB | good | CC | |
| 49 | Sn—8% Zn | No. 38 | 20 | 100 | BB | BB | CC | BB | good | CC | |
| 50 | Sn—8% Zn | No. 39 | 20 | 100 | BB | BB | DD | AA | good | DD | |
| 51 | GI | No. 5 | 20 | 60 | DD | BB | CC | AA | good | AA | |
| 52 | Sn—8% Zn | No. 40 | 20 | 100 | BB | BB | DD | DD | bad | CC | |
| 53 | Sn—8% Zn | No. 41 | 20 | 100 | BB | BB | CC | AA | good | CC | |
| 54 | Sn—8% Zn | No. 42 | 20 | 100 | AA | BB | CC | AA | good | CC | |
| 55 | Sn—8% Zn | No. 42 | 200 | 100 | AA | CC | DD | AA | good | DD | |
| 56 | Sn—8% Zn | No. 43 | 20 | 100 | AA | BB | BB | AA | good | DD | |
| 57 | Sn—8% Zn | No. 44 | 20 | 100 | DD | BB | CC | AA | good | BB | |
| 58 | Sn—8% Zn | No. 45 | 20 | 100 | DD | BB | BB | DD | bad | BB | |
| 59 | Sn—8% Zn | No. 46 | 20 | 100 | DD | BB | DD | DD | bad | BB | |
| 60 | Sn—8% Zn | No. 47 | 20 | 100 | DD | BB | DD | AA | good | BB | |
| 61 | Sn—8% Zn | No. 48 | 20 | 100 | CC (uneven appearance) | CC | AA | AA | good | AA | |
| 62 | Sn—8% Zn | No. 49 | 20 | 100 | AA | BB | CC | DD | bad | AA | |
| 63 | Sn—8% Zn | — | — | — | CC | CC | DD | — | — | AA | |

The invention claimed is:

1. An aqueous treating solution for an Sn-based plated steel sheet, comprising (A) an organic material, (B) a water-soluble chromium compound, (C) a water-dispersible silica, and water, wherein the organic material (A) is at least one member selected from an oxy-acid with the numerical ratio of hydroxyl group/carboxyl group in one molecule being from 3/1 to 10/1, its lactone form and an oxide derivative thereof, the water-soluble chromium compound (B) does not contain hexavalent chromium, and pH is from 0.7 to 6.0.

2. The aqueous treating solution for an Sn-based plated steel sheet as claimed in claim 1, wherein the organic material (A) is an organic material having a carbon number of 4 to 12.

3. The aqueous treating solution for an Sn-based plated steel sheet as claimed in claim 2, wherein the organic material (A) is aliphatic.

4. The aqueous treating solution for an Sn-based plated steel sheet as claimed in 3, wherein the organic material (A) is an ascorbic acid or a derivative thereof.

5. The aqueous treating solution for an Sn-based plated steel sheet as claimed in claim 1, wherein the water-dispersible silica (C) comprises at least two kinds of silicas, that is, spherical silica and chain silica, and the weight ratio therebetween is chain silica/spherical silica =from 2/8 to 8/2 in terms of $SiO_2$.

6. The aqueous treating solution for an Sn-based plated steel sheet as claimed in claim 1, wherein (D) phosphoric acid and/or a phosphoric acid compound is contained as an additional component and the mass ratio between Cr in the treating solution of the present invention and $PO_4$ in the phosphoric acid and/or phosphoric acid component (D) is $PO_4$/Cr=from 1/1 to 3/1.

7. The aqueous treating solution for an Sn-based plated steel sheet as claimed in claim 1, wherein (E) a metal salt is contained as an additional component, the metal is at least one member selected from the group consisting of Mg, Ca, Ba, Sr, Co, Ni, Zr, W and Mo, and the weight ratio of metal to Cr is metal/Cr=from 0.01/1 to 0.5/1.

8. A method for producing an Sn-based plated steel sheet with high corrosion resistance and excellent paint adhesion, comprising coating the aqueous treating solution claimed in claim 1 on a steel sheet having formed thereon an Sn-based plating layer comprising from 1 to 8.8 mass % of Zn and from 91.2 to 99.0 mass % of Sn, and drying the steel sheet.

9. The method for producing an Sn-based plated steel sheet with high corrosion resistance and excellent paint adhesion as claimed in claim 8, wherein the coating weight after coating and drying is, in terms of metal chromium, from 3 to 100 $mg/m^2$ per one surface of said Sn-based plated steel sheet.

* * * * *